United States Patent [19]

Thalmann

[11] 4,303,853

[45] Dec. 1, 1981

[54] METHOD OF AND APPARATUS FOR DETERMINING THE IMPACT SITE OF A BULLET UPON A TARGET

[75] Inventor: Claude Thalmann, Muri, Switzerland

[73] Assignee: Polytronic AG, Muri, Switzerland

[21] Appl. No.: 96,225

[22] Filed: Nov. 20, 1979

[30] Foreign Application Priority Data

| | | | |
|---|---|---|---|
| Nov. 22, 1978 | [CH] | Switzerland | 11986/78 |
| Nov. 22, 1978 | [CH] | Switzerland | 11987/78 |
| Jan. 23, 1979 | [CH] | Switzerland | 694/79 |

[51] Int. Cl.[3] ..... F41J 5/12; G06F 15/20

[52] U.S. Cl. ..... 235/400; 273/372; 367/127; 367/906

[58] Field of Search ..... 235/400; 367/127, 906; 273/372; 35/25

[56] References Cited

U.S. PATENT DOCUMENTS

| | | | |
|---|---|---|---|
| 3,723,960 | 3/1973 | Harris | 367/127 |
| 3,778,059 | 12/1973 | Rohrbaugh et al. | 273/372 |

FOREIGN PATENT DOCUMENTS

| | | | |
|---|---|---|---|
| 2738213 | 7/1978 | Fed. Rep. of Germany | 35/25 |
| 2807101 | 8/1978 | Fed. Rep. of Germany | 273/372 |
| 526763 | 9/1972 | Switzerland | 273/372 |
| 589835 | 5/1977 | Switzerland | 273/372 |
| 595606 | 2/1978 | Switzerland | 273/372 |
| 1553251 | 9/1979 | United Kingdom | 367/127 |

OTHER PUBLICATIONS

Rachele: Sound Ranging Technique for Locating Supersonic Missiles, Journal of the Acoustical Society of America vol. 40 No. 5, pp. 950–954.

*Primary Examiner*—Felix D. Gruber
*Attorney, Agent, or Firm*—Karl F. Ross

[57] ABSTRACT

A target device for ascertaining the proximity of a hit to the target center comprises a plurality of transducers separated from one another in a space behind the target surface and positioned to respond to the impact shock at times determined by the sound propagation velocity in the air of this compartment. To increase the accuracy of the device, means is provided to provide an essentially constant temperature gradient (or uniform temperature) in the space or compartment and/or one sensor more than that required for determining the position of impact when the sound propagation velocity is known, is used.

8 Claims, 9 Drawing Figures

METHOD OF AND APPARATUS FOR DETERMINING THE IMPACT SITE OF A BULLET UPON A TARGET

FIELD OF THE INVENTION

My present invention relates to a method of and an apparatus for determining the impact site of a bullet against a target and especially for determining the impact location or position of a shot against a target, especially for target-shooting competition and preparation therefor, with improved accuracy.

BACKGROUND OF THE INVENTION

It has become increasingly widespread to utilize electronic systems for detecting the impact of a bullet against a target for rifle and pistol competitions or tournaments and rifle and pistol ranges, e.g. in training or preparation for competitive events.

While many different techniques have been proposed for this purpose, the most common utilize groups of sensors, e.g. mechanical/electrical transducers, spaced around a target region and positioned and electronically connected to respond to the acoustic or shock wave on impact at times which can vary in accordance with the relative positions of the impact and the transducer. The electronic circuitry to which these transducers are connected can then evaluate the distance of the impact from the reference point along a coordinate system and signal, for example, the spacing between the hit and the center of the target.

In, for example, Swiss patent No. 526,763, a pair of sensors are arranged on the periphery of a circle concentric with the center of the target, the sensors of the pair being diametrically opposite one another across the center.

The sensors are thus in clearly defined positions relative to a polar coordinate system whose zero point or origin lies at the target center.

If the sound propagation velocity is known, the impact site can be calculated by a computer, e.g. a microprocessor, forming part of the electronic circuitry, from the time-staggered arrival of the shock waves at the different sensors.

A Swiss patent No. 589,835 proposes arranging acoustic sensors in the target plane utilizing them in a similar manner to calculate the impact position based upon the sound propagation velocity in the target.

Customarily the target comprises an image surface carrying the target pattern, e.g. on a fabric layer, behind which a space is formed. Since the transducers are arranged in this space or compartment, it is sound propagation velocity in this region which determines the response of each sensor to the shock or acoustic wave.

Of course, under fixed conditions, the sound velocity can be readily determined.

In practice, however, it is found that a predetermination of the sound velocity is neither possible nor practical.

The sound propagation velocity is dependent on the temperature of the air and, more particularly, is proportional to the square root of the absolute temperature T in Kelvin, the proportionality constant being $$20.034 \frac{(\text{sec. } ^\circ\text{K.})}{m}$$

so that $$C = 20.034 \cdot \sqrt{T}$$

where C is the propagation velocity in m/sec. T is $=\Theta+273.14$ where $\Theta$ is the ambient temperature in °C.

It has been found, in practice, that the temperature gradient in the space behind the target, in conventional systems, is nonlinear and nonuniform. It may constantly change as a function of solar radiation angle and solar radiation intensity, wind velocity and direction, the nature of the paint on the target and dark and light zones on the target image, and, of course, changes in ambient temperature conditions.

It has also been found in practice that all of these variables cannot be accounted for each time the target is to be used and from one use to the next. Furthermore, these variables can cause inaccuracy in results which exceed the tolerance limits established by the international associations conducting shooting competitions such as the U.I.T. (Union International de Tir).

OBJECTS OF THE INVENTION

It is the principal object of the present invention to provide a system for improving the impact-locating accuracy of electronic target-monitoring devices.

Another object of the invention is to provide a method of determining the impact site or location of a shot against a target whereby the drawbacks of earlier systems are obviated.

Yet another object of the invention is to provide an improved apparatus for ascertaining the impact position of a bullet against a target.

SUMMARY OF THE INVENTION

These objects and others which will become apparent hereinafter are attained, in accordance with the present invention, in a bipartite attack on the problem which, surprisingly can be solved by maintaining in the critical region of the target a predetermined temperature gradient notwithstanding the effects discussed above.

More specifically, the present invention provides a target which, in the region of the compartment, is provided with means for maintaining a substantially constant or homogeneous temperature gradient and/or providing an additional sensor (beyond that which would otherwise be required to ascertain the impact location if the sound propagation velocity were known and fixed) as part of the group of sensors feeding input to the electronic circuit.

Moreover, I have found that it is possible through one or more of several modifications of prior art targets, to make the temperature gradient constant in spite of the external influences. For example, while closed chambers behind the target have been provided heretofore, it has been found that opening this chamber at least at the top and bottom will result in a substantially constant temperature gradient alone or in conjunction with means forming a cover over the target area or means for dissipating heat.

It has already been pointed out that the invention alternatively or in addition can make it possible to ignore the average sound velocity between the impact or penetrating point and the transducers, e.g. by providing the aforementioned additional sensor or transducer.

Thus the invention maintains the area of the target plane to the greatest possible extent independent of ambient temperature changes with a predetermined or at least constant temperature gradient and/or makes it possible to totally ignore changes in the sound propagation velocity along the path of the acoustic wave transmitted to the sensors. Naturally, when the additional sensor is used in accordance with the present invention, even temperature and humidity changes in the air along the path can vary without particular problems and hence the additional sensor may be utilized together with the other compensation approaches described.

An important aspect of the present invention is that the temperature gradient measured between practically any point on the target surface or plane and the sensors is the same. This result can be obtained by dissipating or conducting heat away, providing thermal protection in the form of insulation, by inducing a chimney effect through the compartment or space, by providing a target on a heat conducting foil connected with a heat sink or dissipating the heat into the air, or by providing the roof-like cover mentioned previously. Any one or more of these approaches may be combined with any other one of them to afford the desired degree of uniformity of the temperature gradient.

The present invention has both method and apparatus aspects. In the method aspects of the invention, a uniform temperature gradient is maintained along the target plane and/or the sound wave from the impact site is picked up by the additional sensor or transducer which enables an accurate determination of impact location to be made independently of knowledge of the propagation velocity.

In the apparatus aspects of the invention, a target having means as described above can be provided.

More particularly, the target of the present invention can include a target ring formed on a target plane or surface supported by a frame defining a measuring chamber which can be closed at its front and back by fabric covers. The acoustic transducers or sensors can be provided on this frame and can receive the acoustic wave transmitted by the air in this compartment or chamber and one of the canvas covers can be provided with a target layer or can be disposed immediately behind the target layer as required.

The electronic circuitry can include a computer or calculator connected behind the sensors which are disposed in predetermined and well defined positions with respect to a reference coordinate system in order to respond and measure the staggered times of arrival of the shock wave and thereby permit calculation of the impact location.

According to a feature of the invention, means is provided to form a chimney through or along the compartment, i.e. to form an upwardly and downwardly open air circulation space at least between the surface layer carrying the target image and the juxtaposed cover of the measuring chamber, i.e. the front measuring chamber cover.

The chimney space is thus provided upwardly of the chamber. The surface layer carrying the target image may be covered with a thermally conductive layer turned toward this space, i.e. rearwardly, and applied to the back of the target-image layer.

Reaching over the target-image layer there is formed a roof or cover.

The transducers of the present invention can be acoustic pickups or means forming a laser curtain or an electrically conductive layer or any other arrangement whereby the shock wave generated by the impinging bullet can be detected across the space in the measuring chamber.

SPECIFIC DESCRIPTION

Figure 1:
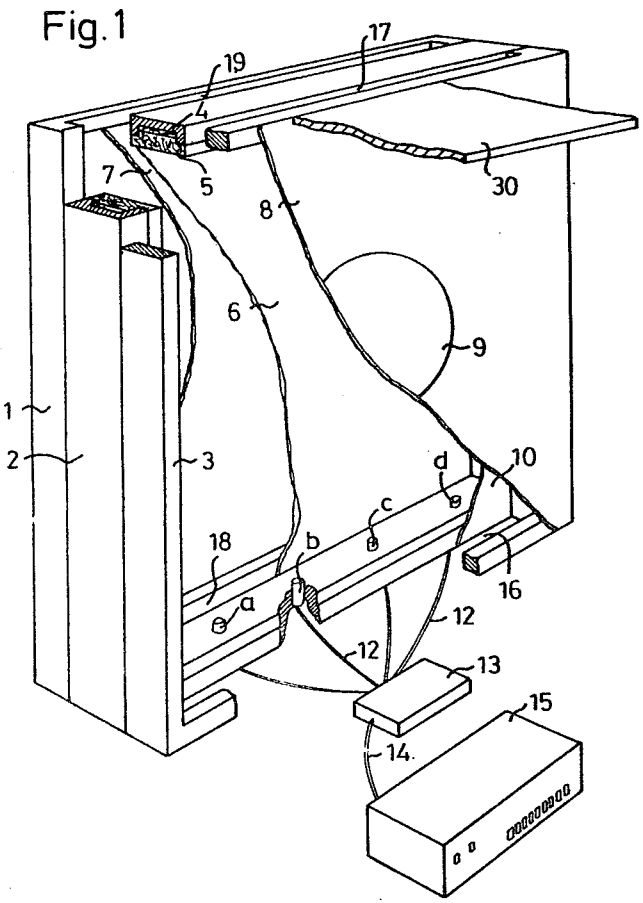
FIG. 1 is a diagrammatic view, partly in section of the target according to the invention.

The target of FIG. 1 comprises a target ring arrangement with a fabric cover 8 drawn onto a frontal wooden frame 3, which generally carries a painted-on target image 9. In the rearward direction, the frontal wooden frame 3 is followed by the wooden frame 2 surrounding the measuring chamber. As shown in cross-section, the measuring chamber frame 2 is provided on the inside with a thermal insulation layer 4 and a sound absorption layer 5. As is readily apparent, the measuring chamber is covered at the front by a fabric cover 10, e.g. having a thickness of 4 to 5 mm. This cover is generally in multilayer form with a plastic support and a sound-absorbing layer on the inside and a sound-reflecting on the outside of the support. The membrane is closed at the back by a fabric cover 6, similar to the front cover 10.

Within the measuring chamber and in this case on the lower part of the measuring chamber frame 2, there are four acoustic sensors or sound recorders a, b, c and d, connected by means of corresponding conductors 12 with an amplifier 13, which is in turn connected by line 14 with a computer 15.

In the conventional closed-ring target, the front frame 3 with the target image cover 8 is placed in all-round closed manner on the measuring chamber frame 2 or the target image cover 8 forms a layer on the front measuring chamber cover 10.

With the present invention, however, a chimney with air circulation slots 16 and 17 on the lower and upper edges of the arrangement is located between the target image cover 8 and the front measuring chamber cover 10.

As target ring arrangements of this type can seldom be constructed in an ideal manner with a precisely northerly firing direction, a similar chimney construction is also provided here on the back of the arrangement, so that a rear frame 1 with a rear and in this case white cover 7 is linked with the measuring chamber frame 2. The rear measuring chamber cover 6 and the rearmost cover 7 again define a chimney with air slots 18 and 19.

Figure 2:
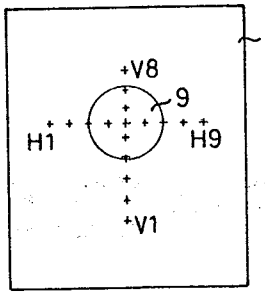
FIG. 2 is a graphical representation of the measuring points on the target.
Figure 3:
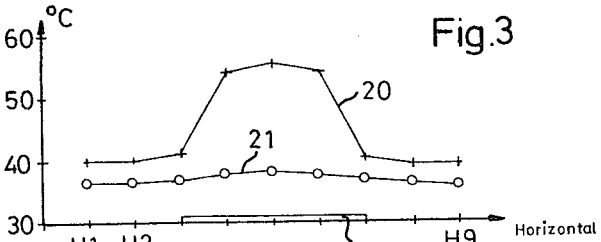
FIG. 3 is a first graph of the temperature gradients of a first group of measuring points.
Figure 4:
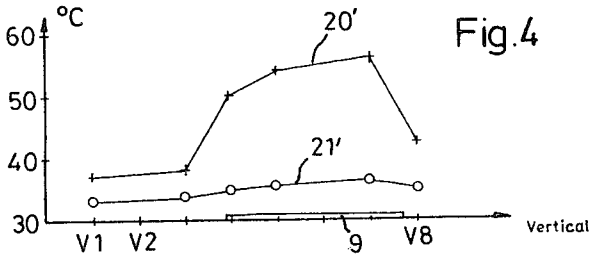
FIG. 4 is a second graph of the temperature gradients of a second group of measuring points.

From FIGS. 2, 3 and 4 one can see the heat distribution action over the entire target plane attainable with this target ring construction, as compared with a prior art (closed) ring system.

FIG. 2 shows the measuring points along the horizontal and vertical lines through the center of an international one-meter diameter 10 ring target, the measurements being carried out in each case on or in "closed" ring and on or in corresponding rings according to the present invention, in order to obtain mean values based on an outside temperature of 30° C.

FIG. 3 shows the temperature gradient along the horizontal line and curve 20 in this case relates to "closed" rings and curve 21 to the "air chamber" rings according to the invention.

FIG. 4 shows the temperature gradient along the vertical line with curve 20' for the "closed" rings and curve 21' for the "air chamber" rings.

These comparative curves 20 and 21 or 20' and 21' immediately show that a substantially uniform temperature gradient is obtained over the entire target plane as a result of the inventive measures, whereby in the hitherto extreme areas an improvement in the shot position measurement of a factor of 10 is obtained compared with the prior art "closed" rings.

In addition to or without the chimney effect, a similar or even improved heat distribution can be obtained by arranging a heat conducting foil, for example copper foil or a copper evaporation coating, e.g. on the back of the target image cover 8.

A similar or even further improved heat distribution can be obtained by a preferably additional and optionally also singly usable thermal protection by means of a roof-like covering 30 which, as shown, can extend forward from the upper frame edge of the front wooden frame. This covering can also rest directly on the upper frame surface or to spacedly cover the same. Alternatively it is possible to replace the flat covering by a ridged roof covering or by providing an inclined covering. Advantageously, the covering 30 is appropriately coated to increase the thermal protection action.

Figure 5:
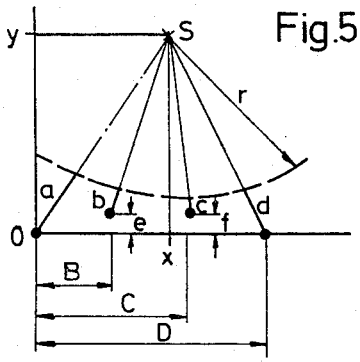
FIG. 5 is a coordinate system for illustrating the shot point calculation.

FIG. 5 shows that the four acoustic sensors a, b, c and d assume a clearly defined position with reference to a cartesian coordinate system.

Figure 6:
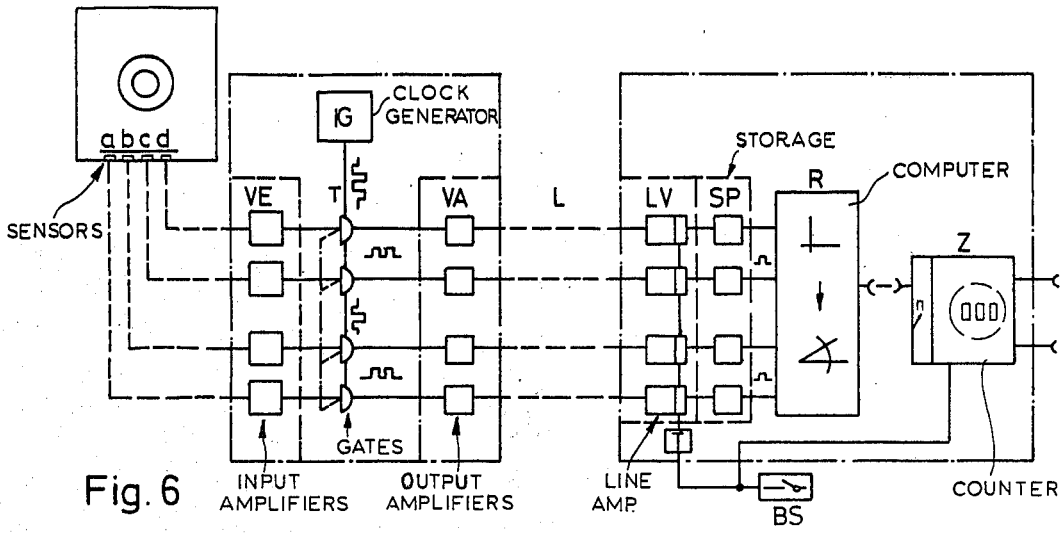
FIG. 6 is a diagrammatic representation of the evaluation means with the computer belonging to the target.

The signals produced by acoustic sensors a, b, c, d as a result of a shock wave are, as shown in FIG. 6, amplified by input amplifiers VE and then fed to gates T at which there are the pulses of a clock generator IG. The clock rate of clock generator IG determines the discrimination, i.e. the accuracy of the shot position calculation. A gate is associated with each sensor a, b, c, d. The pulse of the first sensor affected by a shock wave opens all the remaining gates T, so that the pulses of clock generator IG are fed to the output amplifiers VA. When the shock wave strikes the following sensors, their pulses close the series-connected gates C, so that the number of pulses of clock generator IG let through by the gates T corresponds to the time-staggering of the arrival of the shock wave at the four sensors a, b, c, d. The pulses passed by gates T are amplified in output amplifiers VA and transmitted by means of transmission lines L from the target position to the firing position and an evaluation means having line aplifiers LV, which feed the pulses to a store Sp, one of the latter being associated with each sensor.

On the basis of the stored pulses, corresponding to the staggering in time with which the shock wave reaches sensors a, b, c, d, computer R calculates the shot position in the cartesian coordinate system according to FIG. 5. In a next stage, the computer carries out a coordinate displacement in such a way that the origin O is displaced to the target center 9. In a further stage, the calculated coordinates are transformed into polar coordinates in the computer. The results supplied by computer R are indicated by a balance counter Z provided with a store in such a way that the firing data are represented in figures and the shot position in circular luminous points. Counter Z is reset manually or preferably by an acceleration switch.

The line amplifiers LV are preferably locked and are gated by an acceleration switch BS fixed either to the rifle, the rifleman or his firing mat by means of a time-lag relay set in accordance with the flight time of the bullet. Thus, only shots from the rifleman associated with the particular target are measured and indicated.

It can be seen from FIG. 5 that in the presently described system, the sound propagation velocity at the target need not be known for calculating the shot position. In the represented cartesian coordinate system with the origin O S indicates the shooting-through point of the coordinate plane with which are associated the sought values x and y. In this coordinate system the sensors a, b, c and d located in the coordinate plane have clearly defined positions. In the time interval $t_r$ after shooting-through, the shock wave traverses zone r and after a further time interval $t_c$ first reaches sensor c. After a second time interval $t_b$, the shock wave reaches sensor b and after a third time interval $t_d$ sensor d. Finally, after a fourth time interval it reaches sensor a. Due to the fact that only the shock wave arriving at sensor c can open gates T of the remaining sensors a,b and d and these were only closed when the shock wave reached the corresponding sensors, it is possible to measure from the above-indicated time intervals $t_c = O$ and $t_b$, $t_d$ and $t_a$. Thus, these four time intervals are known, no matter which sensor is affected first. On the basis of these time measurements, the computer R calculates the sought coordinates x and y according to the following equations, v representing the sound velocity.

$$(tr + ta) \cdot v = \sqrt{x^2 + y^2}$$

$$(tr + tb) \cdot v = \sqrt{(x - B)^2 + (y - e)^2}$$

$$(tr + tc) \cdot v = \sqrt{(C - x)^2 + (y - f)^2}$$

$$(tr + td) \cdot v = \sqrt{(D - x)^2 + y^2}$$

These four equations contain four unknowns, namely the sound propagation velocity v, the time tr and the coordinates x and y. They can be converted into two equations with unknowns x and y on which the computer R calculates the sought coordinates x and y from the known or measurable magnitudes a, b,c and d, as well as $t_a$, $t_b$, $t_c$ and $t_d$. The above four equations show that providing a fourth sensor for calculating the coordinates x and y, eliminates the sound propagation velocity term. If there were only three sensors, one of the four equations would be lost and one of the unknowns $t_r$ or v would have to be determined by measurement.

In a further embodiment, the fourth sensor can be an electrically conductive layer held at a clearly defined potential and extending in the target image plane.

Figure 7:
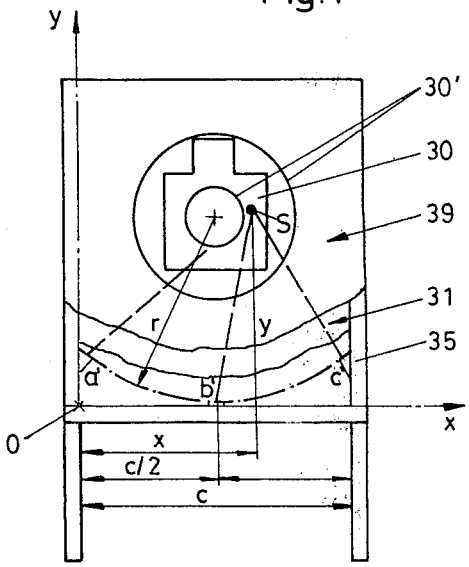
FIG. 7 is a front view of a further embodiment of the invention.
Figure 8:
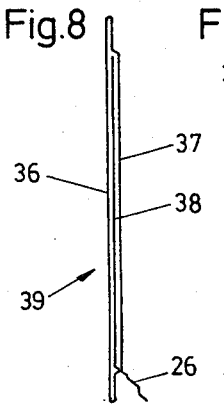
FIGS. 8 and 9 are details in side view relative to the embodiment of FIG. 7.
Figure 9:
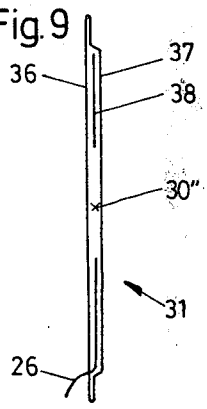

In such an embodiment according to FIG. 7, 8 and 9, foil combinations 39 and 31 are fixed to the front and back of a wooden frame 35. In each case, the foil combinations 39 and 31 comprise two polyethylene foils 36 and 37 with a thickness of about 0.1 mm, between which there is provided an electrically conductive fabric 38. The external dimensions of the fabric 38 are somewhat smaller than those of the polyethylene foils 36 and 37, so that the insulation of fabric 38 is maintained on fixing the foil combinations 39 and 31 to wooden frame 35 by metal clips. The target image 30 in the form of a stylized male figure with the scoring rings 30' is printed on the foil combinations 39 facing the rifleman. Three acoustic sensors a', b' and c' are provided on the lower part of frame 35 on the periphery of a circle of radius r and the position of the sensors is defined with reference to a cartesian coordinate system with the origin O. If the target image 30 and the scoring rings 30' define areas of differing valency, it can be relatively difficult to calculate the value of a hit. Therefore, fabric 38 has an opening 30'' in the form of a target image 30 in the rear foil combination 31, so that the external dimensions of the opening are larger by the diameter of the bullet than in the case of target image 30, which corresponds to the conventional evaluation method.

On penetration of the target at point A, the pulse is obtained on penetrating the foil combination 39 and when the shock wave strikes the acoustic sensors a', b', c'. Thus, it is possible to measure the time required by the shock wave to pass from point S to the acoustic sensors a', b' and c'. In the cartesian coordinate system, the values x and y for the point S can be calculated by the following equations:

$$V(y-y_c)^2+(C-x)^2=v\cdot t_{sc}$$

$$Vx^2+(y-y_a)^2=v\cdot t_{as}$$

$$Vy^2+(x-(C/2)^2=\cdot t_{bs}$$

In these three equations, the values for x and y, as well as for the sound velocity v are unknowns. All the remaining values are known or are determined by measurement. By eliminating the sound propagation velocity term v, these equations can be converted into two equations with two unknowns x and y. Following the calculation of the values x and y in the computer, there is a displacement of the coordinates into the target image center and then a transformation of the coordinates into polar coordinates. As in the present case, the shooting-through point x is located between the two scoring rings 30' the computer must establish whether or not the hit is in target image 30. A figure hit occurs if no signal is transmitted to the computer by foil combination 31, because the bullet has passed through combination 31 in the vicinity of opening 30''. If the shot occurred between image 30 and the outer scoring ring 30', the bullet would pass through fabric 38 in foil combination 31 and as a result a corresponding signal would be transmitted to the computer, which would award a correspondingly lower score for the hit.

If the target image is e.g. a black circular surface on which the scoring rings are concentrically arranged, there is no need for the rear foil combination 31.

An advantage of the above-described embodiment according to FIGS. 7 to 9 compared with evaluation means operating solely with acoustic transducers is that there is no need for the rifleman to have an opening switch which constitutes a permanent incorrect indication risk.

If the target image is subdivided into a few areas with differing values, it is possible to provide a number of foil combinations 31 corresponding to the value. In this case, the size of the openings is adapted to the individual value of scoring surfaces. This embodiment simplifies the determination of the score.

In order to obtain a clearly defined electrical potential on the conductive layer, conductor 26 can be connected across a high-valued resistor to a direct current source with a charging capacitor (not shown). The layer can be charged with a negative voltage of approx. 1000 V. The resistor is then advantageously directly coupled to a very high-valued trigger. The trigger theshold is adjusted according to the local conditions and is selected sufficiently high to prevent any interference factors causing an incorrect indication. Supply takes place through a battery in order to ensure adequate insulation of the supply voltage of the trigger which is at a higher potential. A powerful pulse is available at the trigger output and is supplied via high voltage coupling capacitors to a counter.

Measurements have shown that the bullet always provides a positive charge. It has been calculated from the bullet capacitance of 0.6 pF that the voltage of the bullet relative to ground is approx. +100 V, so that it is not constant. It is dependent on the weather conditions and the terrain flatness and as a result it can be concluded that the variation is caused by the earth's electrical field. Negative voltages have not been observed. Thus, the target is charged via electrical conductor 26 with the indicated high negative voltage of 1000 V. The capacitance of the target is approx. 150 pF. Therefore, the target charge is 1000 V×150 pF. In the least favorable case, the voltage of the bullet relative to ground is zero. If the bullet passes through the target, it is charged to the target voltage, so that the actual target suffers a voltage reduction of approx. 3 V. This voltage reduction is scanned by the trigger and via a counter is indicated as a hit.

I claim:

1. A method of operating a target having a target-image surface adapted to receive the impact of a bullet, comprising the steps of:

disposing a plurality of sensors responsive in time-staggered relationship to the impact of a bullet with the target-image surface for generating electrical signals, said sensors being removed from the target-image surface and spaced apart from one another over a space;

maintaining a substantially constant temperature in said space and between said surface and said sensors to eliminate any influence of air-temperature difference in said space upon the time-staggered relationships of response by said sensors to said impact; and evaluating electrical signals generated by said sensors upon the impact of a bullet with said target and indicating the location of impact.

2. The method defined in claim 1 wherein said temperature gradient is maintained substantially constant by ventilating said space with a chimney effect.

3. A target assembly comprising:

a first layer formed with a target image and constituting an impact surface traversed by a bullet;

a frame disposed behind said layer and formed with front and back covers while defining a chamber;

a plurality of sensors mounted in said chamber at predetermined spaced-apart locations for generating electrical signals in time-staggered relationship upon impact of a bullet on the target, said relationship determining the site of impact;

means connected with and effective in said chamber for maintaining a substantially constant temperature between said layer and said sensors; and means connected to said sensors for evaluating the outputs thereof to indicate the site of impact.

4. The target assembly defined in claim 3 wherein the means for maintaining the substantially constant temperature includes means forming a chimney-like space between said layer and said sensors.

5. The target assembly defined in claim 3 or claim 4 wherein means for maintaining the substantially constant temperature includes a covering projecting forwardly of said surface at the top thereof.

6. The target assembly defined in claim 3 or claim 4 wherein the means for maintaining the substantially constant temperature gradient includes a thermally conductive layer formed on the back of the layer provided with said surface.

7. The target assembly defined in claim 3 wherein four sensors are provided in spaced apart relationship.

8. The target assembly defined in claim 7 wherein at least three of said sensors are acoustic sensors disposed along a side of said frame.

* * * * *